United States Patent [19]

Henry et al.

[11] Patent Number: 4,945,666

[45] Date of Patent: Aug. 7, 1990

[54] REACTIVE FORCE COMPENSATOR FOR PROJECTILE FIRING DEVICE

[76] Inventors: Harold J. Henry, 3143 Mariannwood Dr.; Paul M. Jennusa, 2636 Grand Blvd., both of Port Neches, Tex. 77651

[21] Appl. No.: 385,682

[22] Filed: Jul. 26, 1989

[51] Int. Cl.[5] ..... F41B 5/20; F41C 23/06

[52] U.S. Cl. ..... 42/1.06; 124/89

[58] Field of Search ..... 42/1.06; 124/89, 92

[56] References Cited

U.S. PATENT DOCUMENTS

| | | | |
|---|---|---|---|
| 3,405,470 | 10/1968 | Wesemann | 42/1.06 |
| 3,461,589 | 8/1969 | Vironda | 42/1.06 |
| 4,164,825 | 8/1979 | Hutchison | 42/1.06 |
| 4,279,091 | 7/1981 | Edwards | 42/1.06 |
| 4,492,057 | 1/1985 | Kagehiro | 42/1.06 |

FOREIGN PATENT DOCUMENTS

| | | | |
|---|---|---|---|
| 1296201 | 11/1972 | United Kingdom | 124/89 |

OTHER PUBLICATIONS

Bow & Arrow, "Proking Hydraulic Stabilizer", p. 68, Apr. 1986.

*Primary Examiner*—Charles T. Jordan
*Assistant Examiner*—Michael J. Carone
*Attorney, Agent, or Firm*—Browning, Bushman, Anderson & Brookhart

[57] ABSTRACT

A reactive force compensator is provided for a projectile firing device, such as a bow or gun, on which a force is exerted in a given direction when the projectile is fired. The compensator comprises an elongate casing adapted to permit the casing to be mounted on the projectile firing device with the length of the casing parallel to the direction of said force. A weighted piston member is disposed in the casing and adapted to reciprocate therein while remaining parallel thereto. The piston preferably has an aerodynamic end, disposed rearmost with respect to said force, and a more resistive end disposed forwardmost with respect to the force. Preferably, the latter end is defined by a hollow opening endwise through the piston member.

25 Claims, 1 Drawing Sheet

FIG. 1
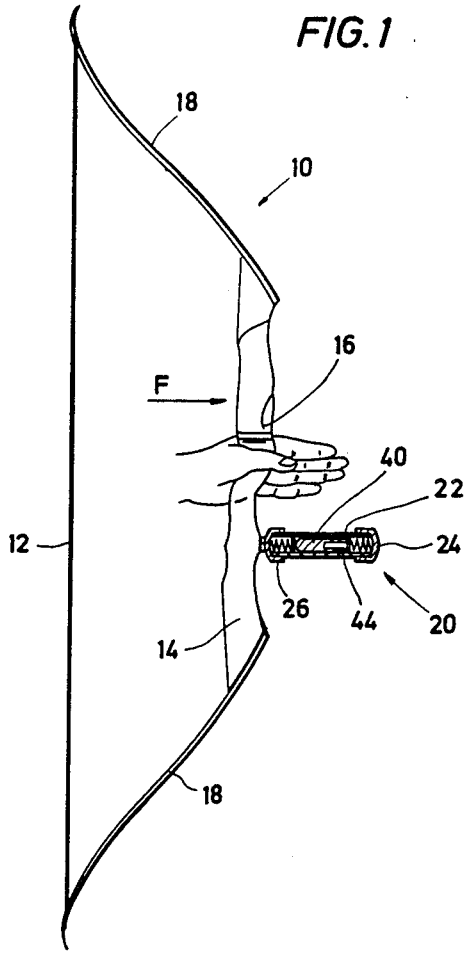
FIG. 3
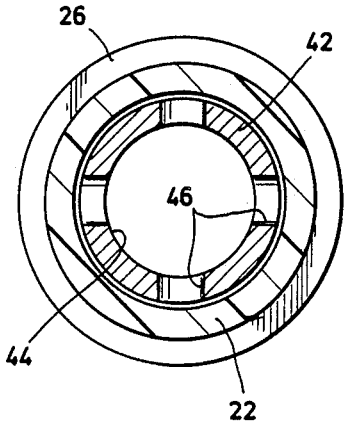
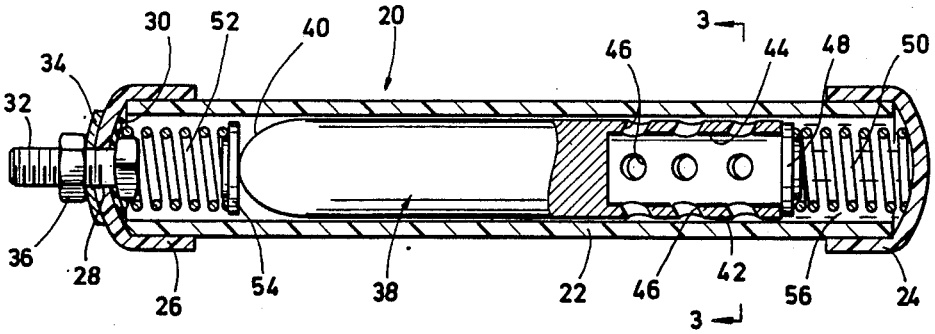
FIG. 2

REACTIVE FORCE COMPENSATOR FOR PROJECTILE FIRING DEVICE

BACKGROUND OF THE INVENTION

1. Field of the Invention

The present invention pertains to accouterments for projectile firing devices, such as bows, although it could also be adapted for use with other kinds of projectile firing devices, such as firearms. A force is exerted on such a firing device in a given direction when the projectile is fired. In the case of a bow, the archer experiences a "kick" wherein the bow feels as if it jumps forward, and the archer must maintain firm control to hold the bow steady or perhaps even avoid dropping it. This can adversely affect not only the accuracy, but even the force, of the archer's shot, and, of course, it greatly affects the archer's comfort. The present invention has been shown to dramatically minimize the "kick" experienced by the archer.

2. Description of the Background

A number of devices have been proposed either for controlling bow kick or for dampening bow vibrations. Some of these simply consist of elongate dead weights which may conveniently be mounted on a fitting provided on the front of most bows, so that the elongate dead weight extends forward horizontally from the bow in use.

An "hydraulic stabilizer" has been offered for sale under the name "Pro King."

British Patent No. 1,296,201 discloses a stabilizer which appears to be intended primarily for use in dampening the vibrations set up by the bow string upon its release. In one embodiment of this device, there is provided a chamber partially filled with liquid in which a spherical element is centered, lengthwise of the chamber, apparently for movement therealong, between two compression springs.

U.S. Pat. Nos. 4,660,538 and No. 4,779,602 likewise disclose compensators or stabilizers having relatively movable parts, reciprocable in a horizontal direction, with the movable parts being the outer or casing-like portions of the devices. Springs are provided to bias the movable members to a given starting position.

U.S. Pat. No. 4,245,612 discloses a device in which generally cylindrically-shaped annular weights are removably mounted in a casing and held by a compression spring. It would appear that these weights may not be intended to move relative to the casing in use, e.g. since a scent-impregnated cylinder is interposed between and abutting the weights and the opposite end of the casing.

U.S. Pat. No. 3.683,883 discloses various forms of stabilizers using magnetized weights, while U.S. Pat. No. 3,342,172 discloses still another "shot cushioning" means for a bow.

SUMMARY OF THE INVENTION

The present invention provides a compensator which is believed to provide better results than the aforementioned prior art, and more specifically, preliminary field tests of the device according to the invention have indicated that its efficacy is quite outstanding.

The compensator of the present invention comprises an elongate casing adapted to permit the casing to be mounted on a bow or other projectile firing device with the length of the casing generally parallel to the direction of the force which is exerted on the firing device when the projectile is fired. The casing has interior walls of constant transverse cross-sectional configuration along a significant portion of its length.

A weighted piston member is disposed in the casing and reciprocable lengthwise of the casing. The piston member has a length, along a significant portion of which the transverse cross-sectional configuration of the piston member mates with that of the constant portion of the interior walls of the casing. The clearance between the piston member and the constant portion of the interior walls of the casing is sufficiently small to maintain the piston member generally parallel to the casing, but sufficiently large to allow free reciprocation of the piston member along the casing.

It has been found that improved results are achieved if the end of the piston member which is rearmost with respect to the direction of the force on the projectile firing device is closed and aerodynamically shaped to facilitate movement of the piston toward the opposed end of the casing, the other end of the piston preferably being adapted to offer greater resistance to movement of the piston toward its respective end of the casing.

Said other end of the piston is preferably hollow and opens longitudinally through the other end of the piston member. The hollow may be defined by a skirt.

Even further improvements are experienced if the skirt is laterally perforated and/or if the casing is partially filled with a liquid such as an hydraulic-type oil. Performance is also believed to be improved by providing a one-way valve in association with the open end of the piston member allowing fluid flow outwardly from the hollow. Such a valve may be held against the open end of the piston member by a compression spring cooperative between the valve and the casing.

Indeed, compression springs or other cushioning means are preferably provided at least between the piston and the aforementioned one end of the casing, and preferably between both ends of the piston member, respectively, and the adjacent ends of the casing. In such case, the same spring can be used to cushion the movement of the piston member toward the other end of the casing and also to hold the valve against the end of the piston, as previously described.

It is a principal object of the present invention to provide an improved reactive force compensator for a projectile firing device.

A corollary object of the present invention is to provide such a compensator in which a weighted piston reciprocable within a horizontally elongated casing is of an improved configuration.

Still another object of the present invention is to provide cushioning means, a liquid volume, and/or a one-way valve, in association with such improved piston member.

Still other objects, features and advantages of the present invention will be made apparent by the following description, the drawings and the claims.

BRIEF DESCRIPTION OF THE DRAWINGS

FIG. 1 is a diagrammatic side view of a bow showing a compensator according to the present invention mounted thereon and illustrating the orientation of the compensator and its parts relative to the bow in use.

FIG. 2 is an enlarged longitudinal cross-sectional view through the compensator of FIG. 1.

FIG. 3 is a transverse cross section taken on line 3—3 of FIG. 2.

DETAILED DESCRIPTION

FIG. 1 shows a side view of a bow 10 comprising a riser section 14 and limbs 18, between the outer ends of which is strung the string 12. The riser section 14 includes a central grip area 16 configured for engagement by the archer's hand. Below the grip area 16, riser section 14, on its forward side, is provided with a threaded female fitting, as is well known in the art. To this fitting there is removably, and more specifically threadedly, mounted a compensator 20 according to the present invention.

Referring now jointly to FIGS. 1, 2 and 3, compensator 20 comprises a casing including an elongate cylindrical tube-like portion 22 and a pair of dome-like end closures 24 and 26 which are fixedly secured to respective opposite ends of cylindrical portion 22 in any suitable manner, preferably one which seals the connection. For example, the parts 22, 24 and 26 of the casing can be formed of a suitable rigid plastic, and the closures 24 and 26 can be interference fitted, bonded, or otherwise sealingly fixed to the cylindrical portion 26.

The casing is adapted to be mounted so that it projects generally horizontally forward from the bow 10 in use, as shown in FIG. 1, and with one end, specifically the end closed by closure 26, rearmost, near the riser section 14 of the bow. It will be appreciated that, in use, when the bow string 12 is drawn back, the archer exerts a forward force on the grip area 16 of the bow. When the bow string is released, the archer feels a kick or tendency for the bow to jump forward, because a force generally represented by the vector F acts on the bow. It will be seen that, when mounted in the manner described, i.e. with closure 26 closest to the bow and the compensator 20 extending horizontally forward therefrom, compensator 20 lies generally parallel to the force F, and with the one end of the compensator adjacent closure 26 rearmost with respect to the direction of the force F. As used herein, the compensator will be considered "generally parallel" to the force F if its lengthwise direction has at least a substantial component which is parallel to the force F.

The manner in which the casing is adapted to be so mounted on the bow is shown best in FIG. 2. Closure 26 has a central endwise bore 28. After closure 26 had been fixed to the adjacent end of cylindrical portion 22 of the casing, a sealing washer 30 is placed inside the casing adjacent to and coaxial with bore 28. Then, a screw 32 is placed through the aligned openings of the washer 30 and the bore 28, from the inside of the casing outward, so that the head of the screw bears against the washer 30 and helps to tighten the seal. Another washer 34, which is curved to match the configuration of the closure 26, is placed about the shank of screw 32 externally of closure 26, followed by a lock nut 36.

It can be seen that the end of screw 32 protrudes beyond nut 36 thereby providing a threaded male member which can be connected to the aforementioned fitting on the bow 10 either directly or with a nipple or the like.

After assembly of the parts associated with closure 26 as described above, the other parts of the compensator can be emplaced within the casing from the other end prior to final closing and sealing by closure 24. These internal parts include a weighted piston 38. "Weighted" will be used herein to refer generically to pistons which inherently have sufficient weight to cause the necessary reciprocation along the casing as well as to pistons to which weight is somehow added.

It will be appreciated that the casing has internal walls which have a constant transverse cross-sectional configuration along a significant portion of the length of the casing, specifically a circular transverse cross-sectional configuration along cylindrical portion 22. The piston member has a length extending generally parallel to that of the casing, and along a significant portion of which the transverse cross-sectional configuration of the piston member mates with that of the constant portion of the interior walls of the casing. In this case, the transverse external configuration of the piston is circular and is of constant diameter except for the aerodynamically formed head end of the piston to be described more fully below. Also, the clearance between the piston member 38 and the portion 22 of the casing is sufficiently small to maintain the piston member generally parallel to the casing, but sufficiently large to allow free reciprocation of the piston member along the casing. Thus, piston member 38 moves like a true piston, remaining in parallel alignment with the casing, by way of contrast, for example, to the spherical element disclosed in British Patent No. 1,296,201.

The end 40 of piston member 38 closest to the mounting end of the casing, i.e. the end carrying closure member 26, is closed and the adjacent portion of the piston member solid, providing the bulk of the weight of the piston. The solid portion of the piston represents slightly more than half its length and extends through a substantial part of the aforementioned constant diameter part of the piston member. As previously mentioned, the one end 40 is aerodynamically configured, like a bullet head, to facilitate movement of piston member 38 toward the mounting end of the casing.

The other end of piston member 38 is preferably configured to offer greater resistance to movement of the piston member toward the other end of the casing, i.e. the free or outer end. More specifically, it has been found that better results are obtained if this other end of the piston is defined by a cylindrical skirt 42 which defines an internal hollow 44 of the piston opening endwise therethrough.

It has further been found that even better results are obtained if the skirt 42 is laterally perforated. In the preferred embodiment shown, the perforations are in the form of twelve bores or ports, nine of which are shown at 46 in FIG. 2. The ports are arranged in sets of four, each set being spaced lengthwise along the skirt 44 from the next, and the ports in each set being circumferentially spaced from each other by 90°. It is believed to be particularly beneficial to incline the ports, as shown, toward the blind end of the piston member 38 from the outer diameter to the inner diameter of the skirt 44. In a preferred embodiment, the angle of inclination of the ports 46 with respect to the axis of the piston member is 45°.

The endwise opening defined by skirt 44 has associated therewith a one-way valve 48, which can be a flapper type, or any other conventional type valve. The valve 48 could be mounted to the skirt 44, but as shown, is held against the outer end of skirt 44 by a compression spring 50 interposed between valve 48 and the end of the casing defined by closure 24. Valve 48 is arranged so as to allow fluid flow from the interior of the skirt to the exterior.

In addition to holding the valve 48 against the open end or skirt end of the piston member 38, compression spring 50 also serves to cushion movements of piston 38 toward the free or outer end of the casing in use. A similar spring 52 coacts between the mounting end of the casing and the closed end 40 of the piston member 38, through an intervening disk-shaped plate 54, to similarly cushion movements of piston member 38 toward the inner or connection end of the casing in use.

Before closing with member 24, the casing has emplaced therein a volume of liquid 56. The volume should not completely fill the free space in the casing unoccupied by other parts of the apparatus, but should fill at least well over half of that space. An example of a suitable liquid is a lightweight oil or hydraulic fluid. The aforementioned clearance between the piston member 38 and the tubular portion 22 of the casing should be sufficient to allow some fluid flow lengthwise across the piston.

The lengths of the piston and casing should preferably be chosen, bearing in mind the space taken up by other parts such as the springs 50 and 52, so that the piston will have a travel of at least about 1-½ inches in use, but preferably somewhat greater travel.

The size and weight of the apparatus can be varied to provide for the requirements of different archers and/or different bows. The device can also be adapted for use on other types of projectile firing devices, e.g. for use on firearms to compensate for recoil. The primary changes which would have to be made in the latter case would be that the means of mounting the apparatus on, for example, a rifle, would have to be changed, and the orientation of mounting would be reversed, since the recoil force for which compensation is desired is rearward with a rifle, rather than forward as with a bow.

Whether intended for use with bows, firearms, or perhaps even other types of projectile firing devices, various modifications might be made over the preferred embodiment described above. Accordingly, it is intended that the scope of the present invention be limited only by the claims which follow.

What is claimed is:

1. A reactive force compensator for a projectile firing device on which a force is exerted in a given direction when the projectile is fired, the compensator comprising:

an elongate, closed casing adapted to permit the casing to be mounted on the projectile firing device with the length of the casing generally parallel to the direction of said force on the projectile firing device, the casing having interior walls of constant transverse cross-section configuration along a significant portion of its length;

a weighted piston member disposed in the casing and reciprocable lengthwise of the casing, the piston member having a length, along a significant portion of which the transverse cross-sectional configuration of the piston member mates with that of the constant portion of the interior walls of the casing, said piston member having a closed end facing one end of the casing and a hollow skirt adjacent, and opening longitudinally through, the other end of the piston member;

the space between the piston member and the constant portion of the interior walls of the casing being sufficiently small to maintain the piston member generally parallel to the casing, but sufficiently large to allow free reciprocation of the piston member along the casing;

cushioning means comprising a resilient means disposed between the piston member and said one end of the casing, the casing being so adapted to be mounted on the projectile firing device with said one end of the casing rearmost with respect to the direction of said force on the projectile firing device; and a volume of liquid disposed in the casing.

2. The compensator of claim 1 wherein the cushioning means comprises a compression spring.

3. The compensator of claim 1 wherein the cushioning means further comprises another resilient means disposed between the piston member and the other end of the casing.

4. The compensator of claim 1 wherein the volume of liquid is insufficient to.completely fill the space in the casing otherwise unoccupied by other parts of the compensator.

5. The compensator of claim 4 wherein the space between the piston member and the constant portion of the interior walls of the casing is sufficiently large to allow passage of liquid across the piston member lengthwise of the casing.

6. The compensator of claim 4 wherein the liquid comprises hydraulic oil.

7. The compensator of claim 1 wherein the closed end of the piston member is aerodynamically configured to facilitate movement of the piston member toward said one end of the casing.

8. The compensator of claim 1 wherein the skirt is laterally perforated.

9. The compensator of claim 8 wherein the perforations are inclined toward said one end of the casing from the exterior to the interior of the skirt.

10. The compensator of claim 8 further comprising a one-way valve element associated with the open end of the piston, the valve being adapted to allow flow of fluid outwardly from the interior of the skirt.

11. The compensator of claim 10 wherein the valve is held against the open end of the piston by a compression spring interposed between the valve and the casing.

12. The compensator of claim 1 wherein the casing is so adapted for mounting by a threaded member carried on and extending lengthwise of the casing for attachment to a fitting on a bow.

13. A reactive force compensator for a projectile firing device on which a force is exerted in a given direction when the projectile is fired, the compensator comprising:

an elongate, closed casing adapted to permit the casing to be mounted on the projectile firing device with the length of the casing generally parallel to the direction of said force on the projectile firing device and one end of the casing rearmost with respect to the direction of said force on the projectile firing device;

a weighted piston member disposed in the casing and reciprocable lengthwise of the casing, the piston member having a closed end facing said one end of the casing and a hollow end opening longitudinally through the other end of the piston member; and a volume of liquid disposed in the casing.

14. The compensator of claim 13 wherein the volume of liquid is insufficient to completely fill the space in the casing otherwise unoccupied by other parts of the compensator.

15. The compensator according to claim 13 wherein the closed end of the piston member is aerodynamically configured to facilitate movement of the piston member toward said one end of the casing.

16. The compensator according to claim 15 wherein the piston member has a skirt defining said hollow end and said lengthwise opening through said other end of the piston member, and wherein the skirt is laterally perforated.

17. The compensator of claim 16 wherein the perforations are inclined toward said one end of the casing from the exterior to the interior of the skirt.

18. The compensator of claim 17 further comprising a one-way valve associated with the open end of the piston, the valve being adapted to permit fluid flow outwardly from the interior of the skirt.

19. The compensator of claim 18 wherein the valve is held against the open end of the piston by a compression spring interposed between the valve and the casing.

20. The compensator of claim 13 further comprising means in the casing for resiliently cushioning movement of the piston member toward said one end of the casing.

21. The compensator of claim 20 further comprising means in the casing for resiliently cushioning movement of the piston member toward said other end of the casing.

22. A reactive force compensator for a projectile firing device on which a force is exerted in a given direction when the projectile is fired, the compensator comprising:

an elongate, closed casing adapted to permit the casing to be mounted on the projectile firing device with the length of the casing generally parallel to the direction of said force on the projectile firing device and one end of the casing rearmost with respect to the direction of said force on the projectile firing device;

weighted piston member disposed in the casing and reciprocable lengthwise of the casing, the piston member having a closed end facing said one end of the casing, the closed end being aerodynamically configured to facilitate movement of the piston member toward said one end of the casing, the other end of the piston member being configured to offer greater resistance to movement of the piston member toward the other end of the casing; and a volume of liquid disposed in the casing.

23. The compensator of claim 22 wherein the volume of liquid is insufficient to completely fill the space in the casing otherwise unoccupied by other parts of the compensator.

24. The compensator of claim 22 further comprising means in the casing for resiliently cushioning movement of the piston member toward said one end of the casing.

25. The compensator of claim 24 further comprising means in the casing for resiliently cushioning movement of the piston member toward said other end of the casing.

* * * * *